US008022296B2

(12) United States Patent
Montena

(10) Patent No.: US 8,022,296 B2
(45) Date of Patent: Sep. 20, 2011

(54) COAXIAL CABLE CONNECTOR INSULATOR AND METHOD OF USE THEREOF

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 133 days.

(21) Appl. No.: 12/356,878

(22) Filed: Jan. 21, 2009

(65) Prior Publication Data

US 2010/0184326 A1 Jul. 22, 2010

(51) Int. Cl.
*H01B 11/18* (2006.01)

(52) U.S. Cl. ..... 174/28

(58) Field of Classification Search ..... 174/21 C, 174/28

See application file for complete search history.

(56) References Cited

U.S. PATENT DOCUMENTS

| | | | | |
|---|---|---|---|---|
| 3,437,960 | A | 4/1969 | Ziegler, Jr. | |
| 3,813,475 | A * | 5/1974 | Cronin | 174/21 C |
| 3,936,132 | A | 2/1976 | Hutter | |
| 3,944,716 | A * | 3/1976 | Katzbeck et al. | 174/21 R |
| 4,288,652 | A * | 9/1981 | Kemeny et al. | 174/21 C |
| 4,431,255 | A | 2/1984 | Banning | |
| 4,555,227 | A | 11/1985 | Ditscheid | |
| 4,906,207 | A | 3/1990 | Banning et al. | |
| 5,383,798 | A | 1/1995 | Lin | |
| 5,804,972 | A | 9/1998 | de Kock et al. | |
| 5,922,155 | A | 7/1999 | Clouet et al. | |
| 5,957,724 | A | 9/1999 | Lester | |
| 5,971,770 | A | 10/1999 | Richmond | |
| 6,068,499 | A | 5/2000 | Kuriyama et al. | |
| 6,393,698 | B1 | 5/2002 | Kuriyama et al. | |
| 2005/0079760 | A1 | 4/2005 | Vaccaro | |
| 2007/0267717 | A1 | 11/2007 | Van Swearingen | |
| 2008/0311788 | A1 | 12/2008 | Vaccaro | |

FOREIGN PATENT DOCUMENTS

| | | |
|---|---|---|
| JP | 2-165519 | 6/1990 |
| JP | 2-268002 | 11/1990 |
| JP | 9-167662 | 6/1997 |
| JP | 11-67380 | 3/1999 |
| JP | 3129992 B2 | 1/2001 |

OTHER PUBLICATIONS

PCT/US2010/020877, International Filing Date: Jan. 13, 2010. International Search Report and Written Opinion. Date of Mailing: Sep. 7, 2010.

* cited by examiner

*Primary Examiner* — Chau N Nguyen
(74) *Attorney, Agent, or Firm* — Schmeiser, Olsen & Watts, LLP

(57) ABSTRACT

A coaxial cable connector having an insulator is provided, the connector insulator including a body having a circumferential surface and a central longitudinal axis, the body having a first axial end and a second axial end and having a first reentrant cavity extending from the first end toward the second end, wherein at least a portion of a wall surface of the first reentrant cavity is oblique to a central axis of the body. A corresponding method of insulating a coaxial cable connector is disclosed.

13 Claims, 13 Drawing Sheets

COAXIAL CABLE CONNECTOR INSULATOR AND METHOD OF USE THEREOF

BACKGROUND OF INVENTION

1. Technical Field

The present invention relates generally to coaxial cable connectors. More particularly, the present invention relates to a coaxial cable connector insulator and related methodology for effective physical and electrical insulation and improved impedance matching.

2. Related Art

Cable communications have become an increasingly prevalent form of electromagnetic information exchange and coaxial cables are common conduits for transmission of electromagnetic communications. There are several coaxial cable connectors commonly provided to facilitate connection of coaxial cables to each other or to various communications devices. It is important for coaxial cable connectors to insulate cable signals so that cable communications may be exchanged properly.

Typical coaxial cable connector insulators utilize materials and designs which seek to maximize structural and functional efficacy. For example, as depicted in FIGS. 1 and 2, a common insulator 10 is positioned within a typical connector 20 between an outer conductor 50 and an inner conductor 90. The connector 20 has a first end 21 and a second end 22. The portion of the connector 20 extending generally from the insulator 10 to the first end 21 of the connector 20 is a first impedance section 23 of the connector 20. An opposite portion of the connector 20 extending generally from the insulator 10 to the second end 22 of the connector 20 is a second impedance section 24 of the connector 20. Insulators, such as insulator 10, are commonly disposed within the connector 20 to maintain structural concentricity of the relationship between the inner conductor 90 and the outer conductor 50 of the coaxial cable connector 20. Additionally connector insulators are also utilized in matching impedance between portions of the coaxial cable connector, such as between the first impedance section 23 and the second impedance section 24 of the connector 20. Impedance matching is affected by dielectric behavior of insulator materials. The common connector insulator 10 is typically comprised of readily injection moldable thermoplastic, but other known connector insulators are sometimes formed of Teflon® (or PTFE) due to the material's effective dielectric properties and ability to form a good physical barrier, while also lending some structural support to connector components. However, PTFE insulators are generally more costly to manufacture and do not provide optimal structural support. Connector insulators formed of readily injection moldable thermoplastics are cheaper to manufacture than PTFE insulators, because PTFE is not readily moldable and therefore must generally be machined into a desired shape. Thermoplastic insulators provide better structural support, but have less effective dielectric properties than PTFE insulators. Accordingly, common thermoplastic insulator designs have included hollowed out sections to decrease the amount of material forming the insulator, thereby improving dielectric performance. For instance, some common insulators, such as insulator 10 depicted in FIG. 1, comprise a generally ring-like structure having a reentrant cavity 42 extending from an axial end of the insulator 10 and thereby forming a substantially C-shaped cross-section 12. The insulator 10 may have web members 60, which in cross-section view have a generally rectangular-shaped cross-section 62. While the known C-shaped cross-section 12 insulator 10 does enjoy some improved dielectric performance over a solid block ring insulator formed of the same material, the typical disk-like solid mass of radial plastic 14 running orthogonally from the inner axial surface 16 of the insulator to the outer axial surface 18 generates a low unmatched impedance zone that contributes to unwanted signal reflection. Hence, because of the structural deficiencies of PTFE insulators and the dielectric deficiencies of the standard C-shaped cross-section 12 insulators 10, there exists a need for a coaxial cable connector insulator that is cheap and easy to manufacture with good physical properties, better dielectric performance, and improved impedance matching.

SUMMARY OF THE INVENTION

The present invention provides an apparatus for use with coaxial cable connections that offers improvements over the abovementioned deficiencies.

A first aspect of the present invention provides a coaxial cable connector insulator comprising: a body having a circumferential surface and a central longitudinal axis, the body having a first axial end and a second axial end, the body including a first reentrant cavity extending from the first end toward the second end, wherein at least a portion of a wall surface of the first reentrant cavity is oblique to the central axis of the body.

A second aspect of the present invention provides a coaxial cable connector insulator comprising: an inner ring member, having a first axial end and a second axial end; an outer ring member, being coaxial with the inner ring member and radially surrounding at least a portion of the inner ring member; and a connecting member extending between and integrating the inner ring member and the outer ring member, wherein at least a portion of the connecting member is oblique to the shared axis of the inner and outer ring members.

A third aspect of the present invention provides a coaxial cable connector comprising: an outer conductor; a center conductor, positioned coaxially within the outer conductor; and an insulator, positioned between the outer conductor and the center conductor, wherein the insulator includes a body having a substantially Z-shaped cross-section revolved around the shared axis of the outer conductor and the center conductor.

A fourth aspect of the present invention provides a coaxial cable connector comprising: a center conductor surrounded by a coaxially aligned outer conductor; means for physically stabilizing and electrically insulating the center conductor in relation to the outer conductor, wherein the means are located within the connector between a first impedance section of the connector and a second impedance section of the connector, wherein the means ensure impedance matching between the first impedance section of the connector and the second impedance section of the connector as measured by time domain reflectometry, wherein the means are comprised of readily injection moldable thermoplastic.

A fifth aspect of the present invention provides a coaxial cable connector insulation method comprising: providing a coaxial cable connector including an outer conductor and a center conductor each sharing a central axis; providing an insulator, wherein the insulator includes a body including a circumferential surface and a central longitudinal axis, the body having a first axial end and a second axial end, the body further including a first reentrant cavity extending from the first end toward the second end, wherein at least a portion of a wall surface of the first reentrant cavity is oblique to the central axis; stabilizing the connector by positioning the insulator between the outer conductor and the center conductor to create a sealed physical barrier between the outer conductor and the center conductor; and ensuring impedance matching between a first impedance section of the connector and a second impedance section of the connector, the first impedance section of the connector extending axially from a first end of the connector to the insulator, and the second impedance section of the connector extending axially from a second end of the connector to the insulator.

The foregoing and other features of the invention will be apparent from the following more particular description of various embodiments of the invention.

DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
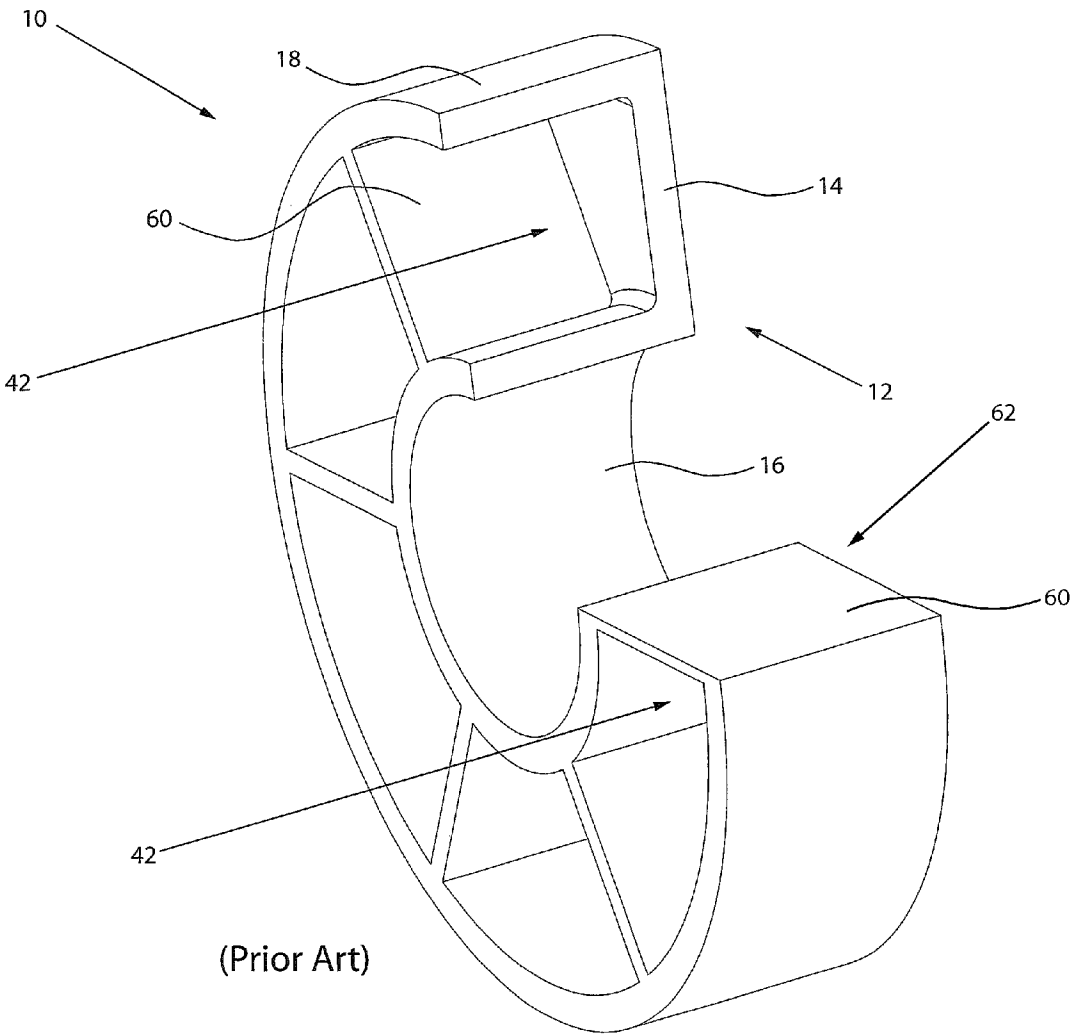
(Prior Art) FIG. 1
FIG. 1 depicts a cut-away perspective view of an embodiment of a prior art coaxial cable connector insulator made of injection molded thermoplastic and having a substantially C-shaped cross-section.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

It is often necessary to insulate various standard coaxial cable connector components in order to maintain the integrity of communication signals that typically pass through coaxial cable connectors. Hence, known ring-like insulators have been positioned in coaxial connectors between the inner conductors of the connectors and the outer conductors of the connectors to help preserve signal integrity. However, insulating material can impede signal transmission. Thus ring-like insulators have been provided having reduced material portions to help lessen the potential for impedance. For example, a reentrant cavity 42 can be introduced into a solid block of ring-like insulating material to form a standard C-shaped cross-section 12 insulator 10 (see FIG. 1) and the C-shaped insulator 10 may be positioned between an outer conductor 50 and a center conductor 90 of a typical connector 20, as partially depicted in FIG. 2. Typical C-shaped connector insulators 10 may include one or more supportive web members 60 to help provide structural stability to both the insulator 10 and the connector 20. However, as mentioned previously, the C-shaped insulator 10 design exhibits a low impedance zone corresponding to the substantially orthogonal solid plastic portion 14 extending between the inner 16 and outer surfaces 18. To overcome this deficiency, research and testing was conducted by the inventor to determine an insulator design that overcomes the disadvantages of the known C-shaped cross-section 12 insulator 10. A connector insulator was designed having a shape with no surfaces positioned orthogonally with respect to a central axis. Accordingly, a connector 200 having an insulator 100 (see FIGS. 3-11*f*) has been determined by the inventor to exhibit significantly better dielectric properties than the common C-shaped cross-section 12 insulator 10, while maintaining cost effective manufacturing advantages and effective structural characteristics.

Figure 3:
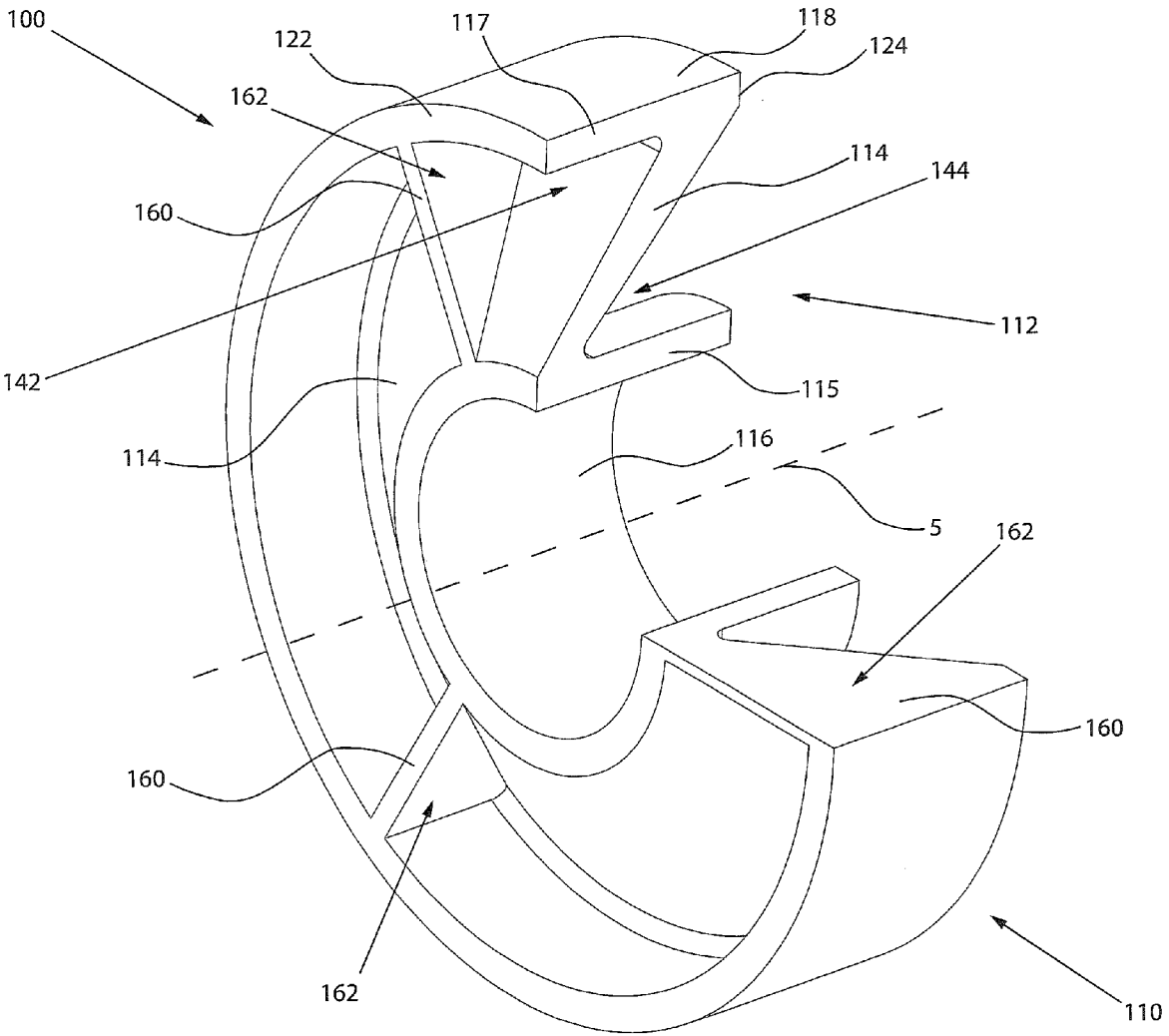
FIG. 3 depicts a cut-away perspective view of an embodiment of a coaxial cable connector insulator made of injection molded thermoplastic and having a substantially Z-shaped cross-section, in accordance with the present invention.

With continued reference to the drawings, FIG. 3 depicts cut-away perspective view of an embodiment of a coaxial cable connector insulator 100. The insulator 100 includes a body 110, having a circumferential surface, such as outer surface 118, and a central longitudinal axis 5. The body 110 has a first axial end 122 and a second axial end 124. The body 110 of the insulator 100 may be ring-like, cylindrical, frusto-conical, tube-like, frusto-cuspoidal, toroidal, doughnut-shaped, torus-like, circinate, or otherwise shaped to have a central generally circular through-hole surrounded by insulating material having a circumferential surface, such as outer surface 118, and ranging between the first axial end 122 and the second axial end 124. The body 110 includes a first reentrant cavity 142 extending from the first axial end 122 toward the second axial end 124. At least a portion of the first reentrant cavity 142 is bounded by a surface of a wall member 114. At least a portion of the surface of wall member 114 is oblique to a central longitudinal axis 5 of the body 110. The insulator 100 may also include a second reentrant cavity 144 extending from the second end 124 of the body 110 toward the first end 122. A portion of the second reentrant cavity 144 may also be bounded by a surface of the wall member 114. Accordingly, at least a portion of a surface of the wall portion 114 of the second reentrant cavity 144 may also be oblique to the central longitudinal axis 5 of the body 110. The first and second reentrant cavities 142 and 144 may share the same wall member 114 having an oblique portion, so that the body 110 has a substantially Z-shaped cross-section 112 revolved around the central longitudinal axis 5. The insulator 100 may include an outer ring member 117 forming a radially outermost portion of the ring-like body 110. The outer ring member 117 may comprise the top portion of the Z-shaped cross-section 112 of an embodiment of insulator 100. The outside surface of the outer ring member comprises the outermost circumferential surface 118 of insulator 100. The outer ring member 117 revolves around the central longitudinal axis 5 and resides coaxially with and may radially surround at least a portion of an inner ring member 115. However, the outer ring member 117 may not surround the inner ring member 115 as long as the wall member 114 connecting the two inner and outer ring members 115 and 117 is positioned to be oblique to the central co-axis. The inner ring member 115 forms a radially innermost portion of the Z-shaped cross section 112 and the inside surface of the inner ring member 115 comprises the inner surface 116 of an embodiment of the insulator 100. The conical wall member 114 comprises a connecting structure that extends obliquely between the outer ring member 117 and the inner ring member 115 and integrates the inner ring member 115 and the outer ring member 117 into a combined circinate or ring-like shape having a Z-shaped cross section 112 comprising a generally ring-like body 110. The conical wall member 114 comprises the diagonal or oblique portion of the Z-shaped cross-section 112.

Figure 4:
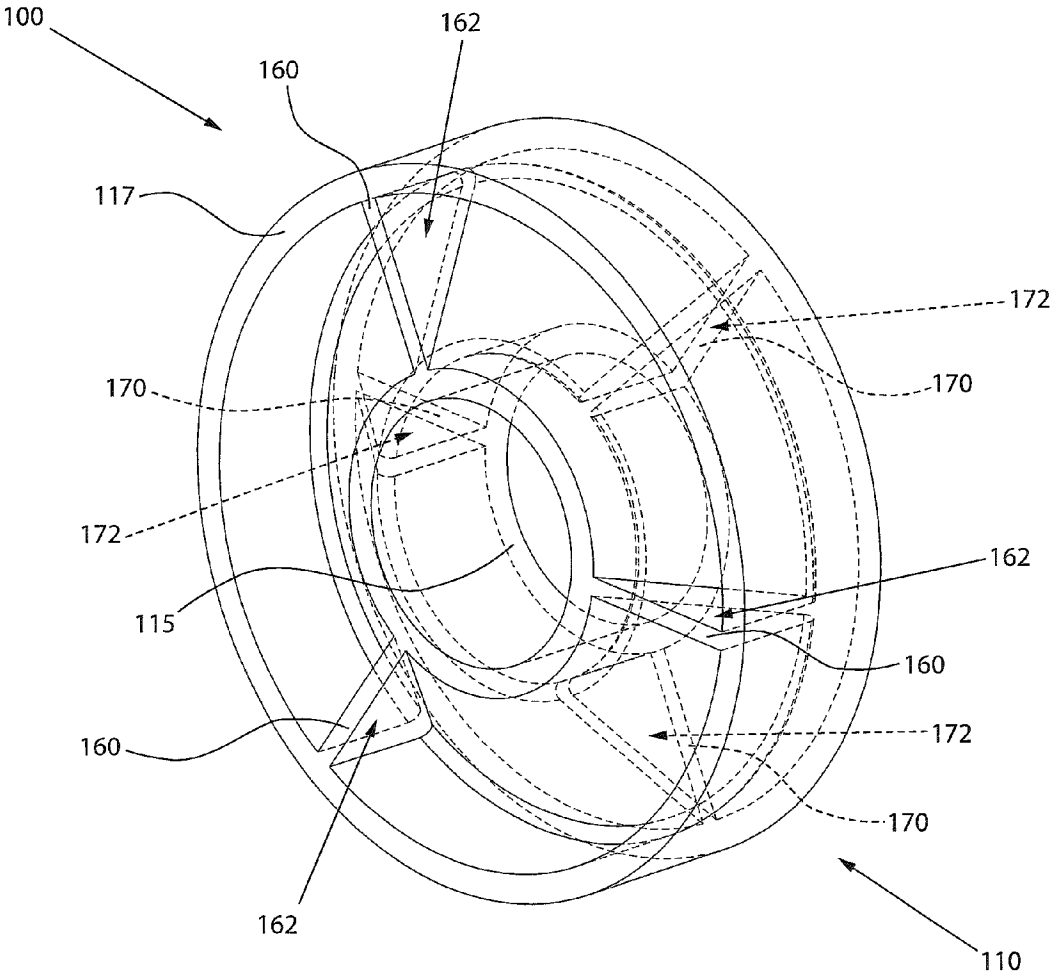
FIG. 4 depicts a perspective view of an embodiment of a coaxial cable connector insulator having a substantially Z-shaped cross-section with hidden features depicted by dashed lines, in accordance with the present invention.

Embodiments of an insulator 100 may be fashioned to help support compression forces applied to the coaxial cable connector 200. For example, in addition to connecting oblique wall members 114, embodiments of an insulator 100 may also include one or more supportive web members to help provide radial strength. There are three viewable outwardly extending supportive web members 160 of an insulator 100 embodiment depicted in FIG. 3. An outwardly supportive web member 160 runs or extends from a portion of wall member 114 to a radially outermost portion or outer ring 117 of an embodiment of insulator 100 to form a generally triangular cross-section shape 162. In addition, as shown in FIG. 4, an insulator 100 embodiment may include one or more supportive web members that extend inwardly from a portion of wall member 114 to the radially innermost portion or inner ring 115 of the body 110 of the insulator 100 to form a generally triangular cross-section shape 172. FIG. 4 depicts a perspective view of the embodiment of a coaxial cable connector insulator 100 having a substantially Z-shaped cross-section 112 with hidden or non-viewable features, such as inwardly extending supportive web members 170, being depicted by dashed lines. The dashed-line hidden features are provided in FIG. 4, among other things, to reveal that embodiments of a coaxial cable connector insulator 100 may include a plurality of spaced apart supportive web members, wherein the supportive web members may be alternatively located in various structural patterns or may be staggered between outwardly extending web members 160 and inwardly extending web members 170.

Figure 5A:
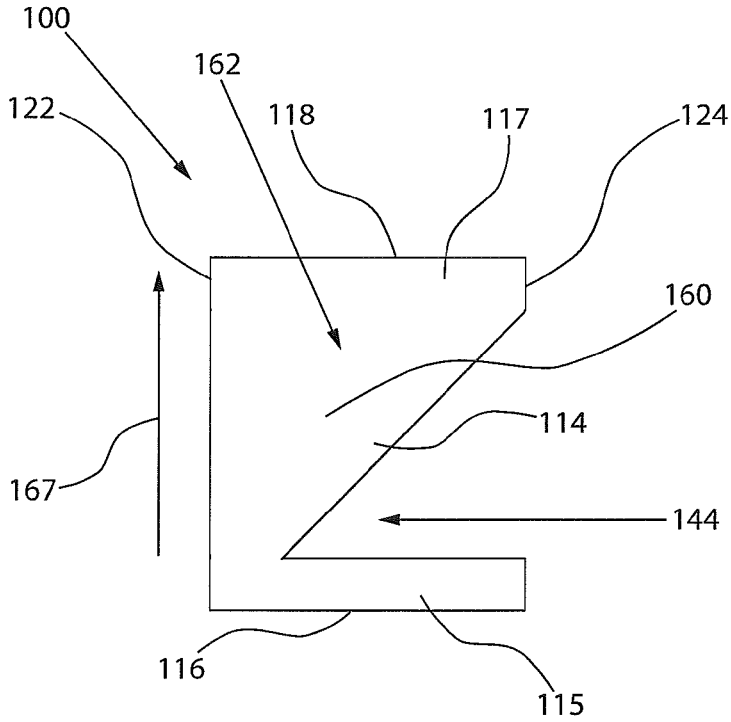
FIG. 5A depicts a cross-section view of a portion of an embodiment of a connector insulator having an outwardly extending web member, in accordance with the present invention.
Figure 5B:
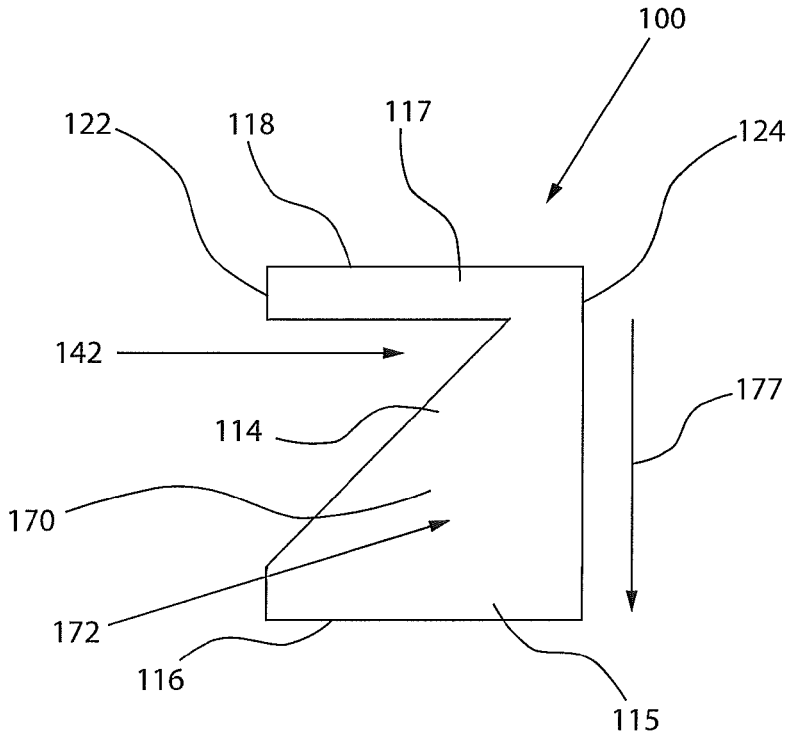
FIG. 5B depicts a cross-section view of a portion of an embodiment of a connector insulator having an inwardly extending web member, in accordance with the present invention.

With further reference to the drawings, FIGS. 5A and 5B depict cross-section views of portions of an embodiment of a connector insulator 100 having supportive web members. In particular, FIG. 5A shows an outwardly extending supportive web member 160. As shown in cross section, the substantial triangular shape 162 of the outwardly extending supportive web member 160 is readily recognizable. Also, in this view the second reentrant cavity 144 also has a substantial triangular shape. Because the outwardly extending supportive web member 160 runs, in a direction 167, from the oblique wall member 114 to the outer ring member 117, those elements become integral with the web member 160. Hence, the outwardly extending supportive web member 160 encompasses the entire structure between the bottom surface of the diagonal wall member 114 to the outer surface 118 of the insulator 100. Therefore, the entire first axial end 122 of the outwardly extending supportive web member 160 comprises a solid structure extending from the inner surface 116 of the insulator 100 to the outer circumferential surface 118 of the insulator 100. However, the second axial end 124 includes a reentrant cavity 144 extending axially to the oblique wall member 114 integrated with the outwardly extending supportive web member 160.

An inwardly extending supportive web member 170 is depicted in FIG. 5B. Such web members 170 are also depicted in dashed lines in FIG. 4. As shown in cross section, the substantial triangular shape 172 of the inwardly extending supportive web member 170 is readily recognizable. Also, in this view the first reentrant cavity 142 also has a substantial triangular shape. Because the inwardly extending supportive web member 170 runs, in a direction 177, from the oblique wall member 114 to the inner ring member 115, those elements become integral with the web member 170. Hence, the inwardly extending supportive web member 170 encompasses the entire structure between the top surface of the diagonal wall member 114 to the inner surface 116 of the insulator 100. Therefore, the entire second axial end 124 of the inwardly extending supportive web member 170 comprises a solid structure extending from the outer surface 118 of the insulator 100 to the inner surface 116 of the insulator 100. However, the first axial end 122 includes a reentrant cavity 144 extending axially to the oblique wall member 114 integrated with the inwardly extending supportive web member 170.

Figure 6A:
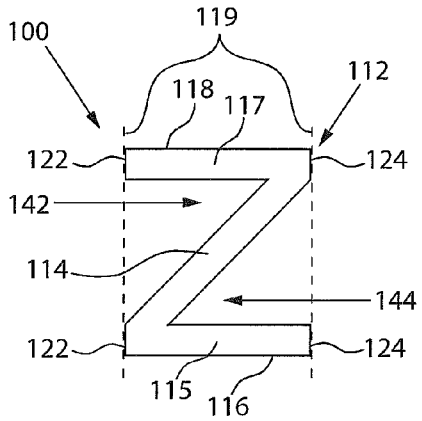
FIG. 6A depicts a cross-section view of a Z-shaped cross-section insulator embodiment having orthogonally aligned outer and inner ring members, in accordance with the present invention.

Because insulating material can impede signal transmission, it may beneficial for a coaxial cable connector insulator be structured having portions of reduced insulating material to help lessen the potential for impedance. Hence, known insulators have included cavities or openings to help decrease impedance associated with the insulator designs. In addition, testing has demonstrated that it is beneficial for a coaxial cable connector insulator to have structure(s) that are oriented in an oblique position with respect to the central longitudinal axis 5 (see FIG. 3) corresponding to signal transmission through a the associated coaxial cable connector. FIGS. 6A-6F depict cross-section views of various embodiments of an insulator 100 having axially oblique insulating structure. In particular, FIG. 6A depicts a cross-section view of a Z-shaped cross-section 112 of an insulator embodiment 100 having orthogonally aligned outer 117 and inner 115 ring members. Dashed markings 119 indicate the orthogonal alignment of the ring members 115, 117. The oblique wall member 114 extends diagonally between the first axial end 122 and the second axial end 124 of the insulator 100 from the inner ring member 115 to the outer ring member 117, thus forming a recognizable Z-shaped cross-section 112. Clearly shown is a first reentrant cavity 142 and a second reentrant cavity 144, the cavities 142 and 144 comprising portions where material was reduced from the overall ring-like body 110 (see FIG. 3) of the insulator 100 embodiment. The bottom of the Z-shaped cross-section comprises the inner surface 116 of the body 110, while the top of the Z-shaped cross-section comprises the outer circumferential surface 118 of the body 110 of the insulator 100. It is appreciated that the structures shown in FIGS. 6A and 6E have advantageous physical properties including desirable strength characteristics that helps concentrically stabilize connector components and effective impedance matching properties, while other shapes may have different physical properties and impedance matching propensities.

Figure 6B:
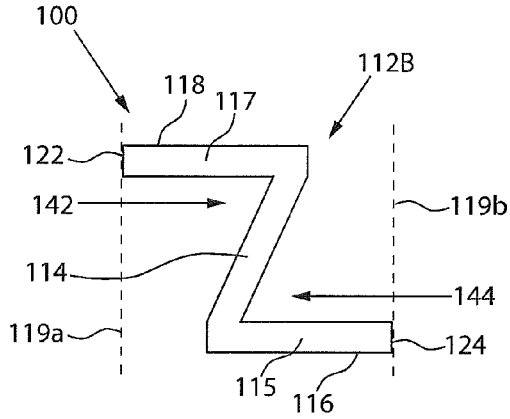
FIG. 6B depicts a cross-section view of a forward leaning Z-shaped cross-section insulator embodiment wherein the diagonal member does not reach the outer orthogonal boundaries of the outer and inner ring members, in accordance with the present invention.
Figure 6C:
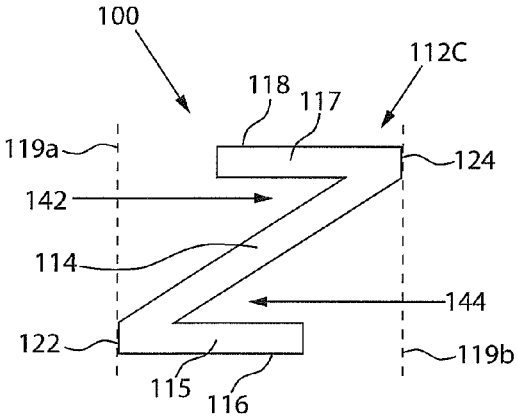
FIG. 6C depicts a cross-section view of a rearward leaning Z-shaped cross-section insulator embodiment, wherein the diagonal member extends beyond the outer orthogonal boundaries of the outer and inner ring members, in accordance with the present invention.

Embodiments of a coaxial cable connector insulator 100 do not need to have orthogonally aligned inner 115 and outer 117 ring members. FIG. 6B depicts a cross-section view of a forward leaning Z-shaped cross-section 112B wherein the diagonal wall member 114 does not reach the outer orthogonal boundaries 119*a* and 119*b* of the outer 117 and inner 115 ring members. The first axial end 122 of the insulator 100 extends beyond the axial boundaries of the wall member 114, while the second axial end 124 also extends in the opposite direction beyond the axial boundaries of the oblique wall member 114. First and second reentrant cavities 142 and 144 are present, though the angle (with respect to the central longitudinal axis 5, see FIG. 3) of the inner surface of the cavities bounded by the wall member 114 is less oblique than the corresponding angle of the embodied insulator 100 depicted in FIG. 6A. The embodied insulator 100 depicted in cross-section view in FIG. 6C is similar to the embodiment depicted in FIG. 6B, in that outer 117 and inner 115 ring members are not orthogonally aligned. However, the insulator 100 embodied in FIG. 6C is somewhat structurally opposite in that it includes a rearward leaning Z-shaped cross-section 112C, wherein the diagonal wall member 114 extends beyond the outer orthogonal boundaries 119*a* and 119*b* of the outer 117 and inner 115 ring members. The first axial end 122 of the insulator 100 is congruent with the axial boundaries of the wall member 114, while the second axial end 124 is also congruent with the axial boundaries of the oblique wall member 114. In addition, first and second reentrant cavities 142 and 144 are present, though the angle (with respect to the central longitudinal axis 5, see FIG. 3) of the inner surface of the cavities bounded by the wall member 114 is more oblique than the corresponding angle of the embodied insulator 100 depicted in FIG. 6A.

Figure 6D:
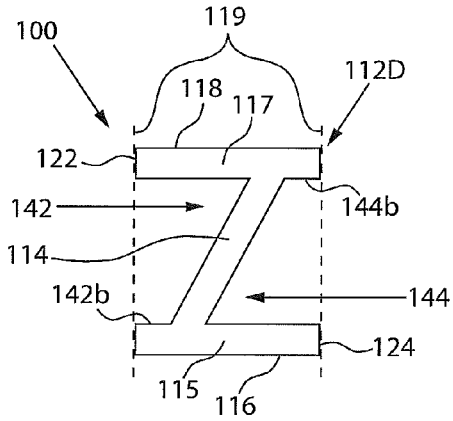
FIG. 6D depicts a cross-section view of a somewhat Z-shaped cross-section insulator embodiment having orthogonally aligned outer and inner ring members, wherein the diagonal member does not reach the outer orthogonal boundaries of outer and inner ring members, in accordance with the present invention.

Embodiments of a coaxial cable connector insulator 100 may include oblique structures that extend from any point of an inner ring member running to any point of an outer ring member. For instance, FIG. 6D depicts a cross-section view of a somewhat Z-shaped cross-section 112D having orthogonally aligned outer 117 and inner 115 ring members, wherein the diagonal member 114 does not reach the outer orthogonal boundaries (depicted by dashed lines and labeled with reference numerals 119) of outer 117 and inner 115 ring members. In this instance, the first and second cavities 142, 144 residing on opposite sides of the wall member 114 do not form substantial triangle shapes. Rather, the cavities are four-sided having small surfaces 142*a* and 144*b* respectively congruent with inner ring member 115 and outer ring member 117.

Figure 6E:
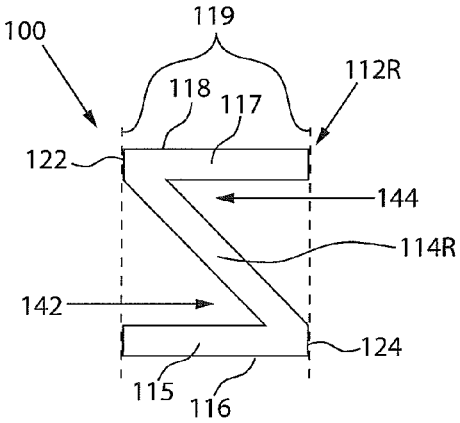
FIG. 6E depicts a cross-section view of a reverse Z-shaped cross-section insulator embodiment having orthogonally aligned outer and inner ring members, in accordance with the present invention.

Embodiments of a coaxial cable connector insulator 100 may include connecting structures that extend obliquely in any direction from an inner ring member running to outer ring member. For example, FIG. 6E depicts a cross-section view of a reverse Z-shaped cross-section 112E insulator embodiment having orthogonally aligned outer 117 and inner 115 ring members. Dashed markings 119 indicate the orthogonal alignment of the ring members 115, 117. The oblique wall member 114R extends diagonally between the first axial end 122 and the second axial end 124 of the insulator 100 from the outer ring member 117 to the inner ring member 115, thus forming a recognizable reverse Z-shaped cross-section 112R. Clearly shown is a first reentrant cavity 142 and a second reentrant cavity 144.

Figure 6F:
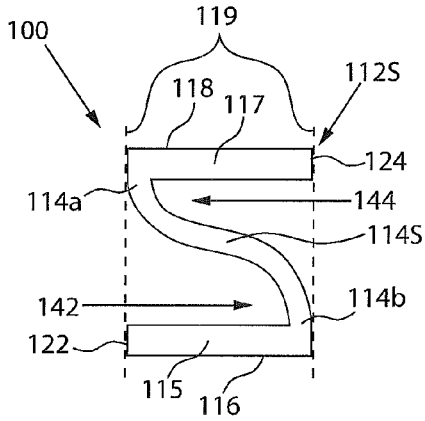
FIG. 6F depicts a cross-section view of an S-shaped cross-section insulator embodiment, in accordance with the present invention.

Embodiments of a coaxial cable connector insulator 100 may include connecting members that have axially perpendicular portions and/or may have curved portions. By way of example, FIG. 6F depicts a cross-section view of an S-shaped cross-section 112S insulator embodiment 100. The connecting wall member 114S includes portions 114*a* and 114*b* that are perpendicular to the central longitudinal axis 5 (see FIG. 3). Nevertheless, the connecting wall member 114S is curved and therefore includes portions that are oblique to the central axis 5. As depicted, the curvature provides the somewhat S-shaped cross-section of the body 110 of the embodied insulator 100. As the connecting wall member 114S is curved, the associated first reentrant cavity 142 and second reentrant cavity 144 will also have curved cavity surfaces. Those in the art should appreciate that curved connecting wall members 114S may curve in any direction and may extend from any point of an inner ring member 115 and run to any point of an outer ring member 117, whether or not the ring members 115 and 117 are orthogonally aligned.

Figure 7:
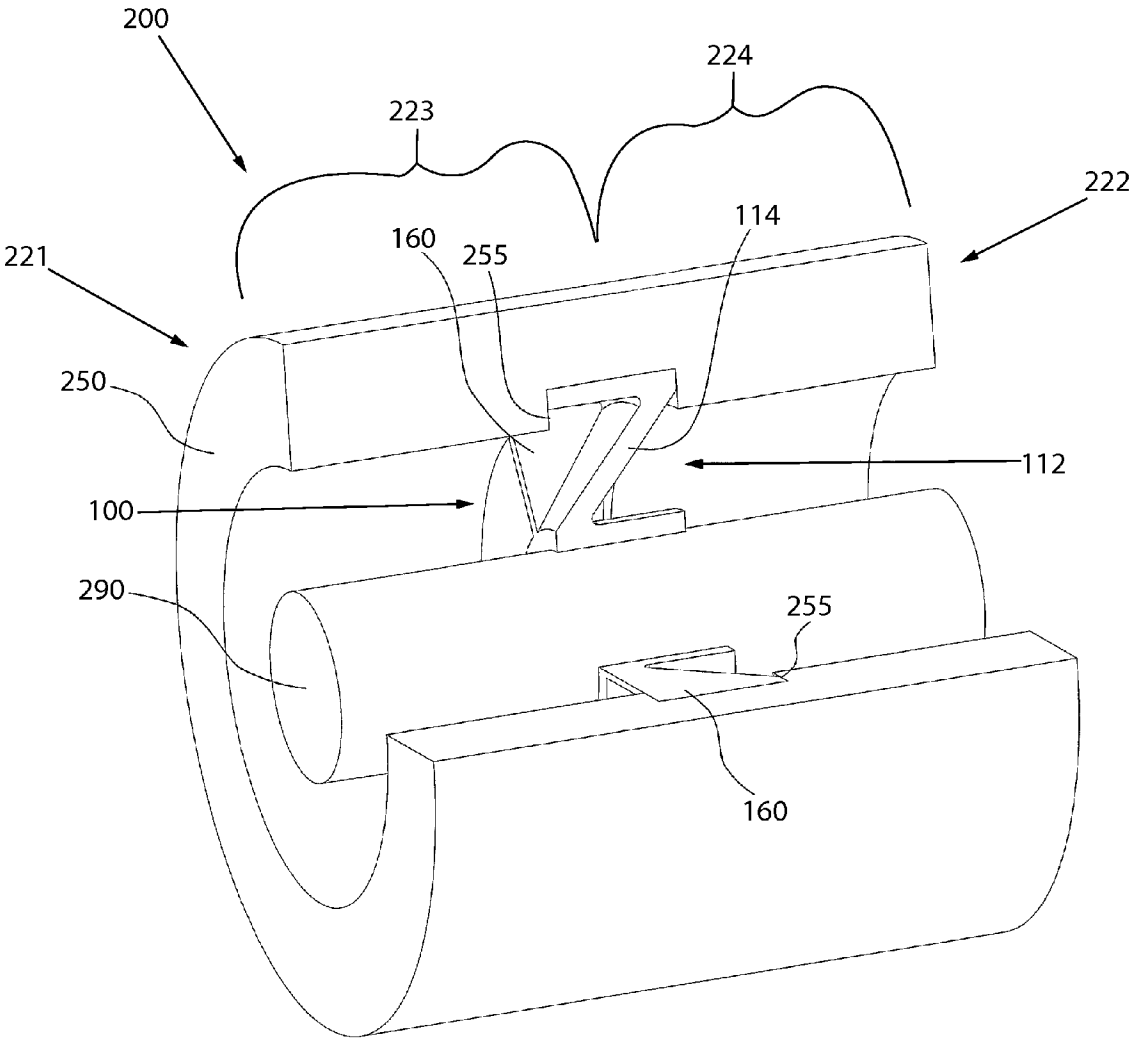
FIG. 7 depicts a partial cut-away perspective view of an embodiment of a coaxial cable connector having an embodiment of a Z-shaped cross-section insulator, in accordance with the present invention.

With continued reference to the drawings, FIG. 7 depicts a partial cut-away perspective view of an embodiment of a coaxial cable connector 200 having an embodiment of a Z-shaped cross-section 112 insulator 100. The insulator 100 is positioned within the connector 200 between an outer conductor 250 and an inner conductor 290. The connector 200 has a first end 221 and a second end 222. The portion of the connector 200 extending generally from the insulator 100 to the first end 221 of the connector 200 is a first impedance section 223 of the connector 200. An opposite portion of the connector 200 extending generally from the insulator 100 to the second end 222 of the connector 200 is a second impedance section 224 of the connector 200. Insulator 100 is disposed within the connector 200 to maintain structural concentricity of the relationship between the inner conductor 290 and the outer conductor 250 of the coaxial cable connector 200. The insulator 100 and the outer conductor and the center conductor may be co-axial all sharing the same central longitudinal axis 5. Additionally connector insulator 100 facilitates matching impedance between portions of the coaxial cable connector 200, such as between the first impedance section 223 and the second impedance section 224 of the connector 200. The body 110 of the insulator 100 may comprise a substantially Z-shaped cross-section revolved around the shared central axis 5 of the outer conductor 250 and the center conductor 290. To help securely seat the insulator 100, the outer conductor 250 may contain a recession or groove 255 or other surface feature that may interact with the insulator 100 and help to retain the insulator 100 in a secure position. In this view, it can be seen that the supportive web members 160 can help provide radial strength the connector 200 and help to keep the outer conductor 250 in a secure position relative to the center conductor 290. The conical wall member 114 serving as the oblique connecting component of the Z-shaped cross section 112 of the insulator 100 also provides radial strength and support to both the insulator 100 and the coaxial cable connector 200 when installed therein.

Figure 8:
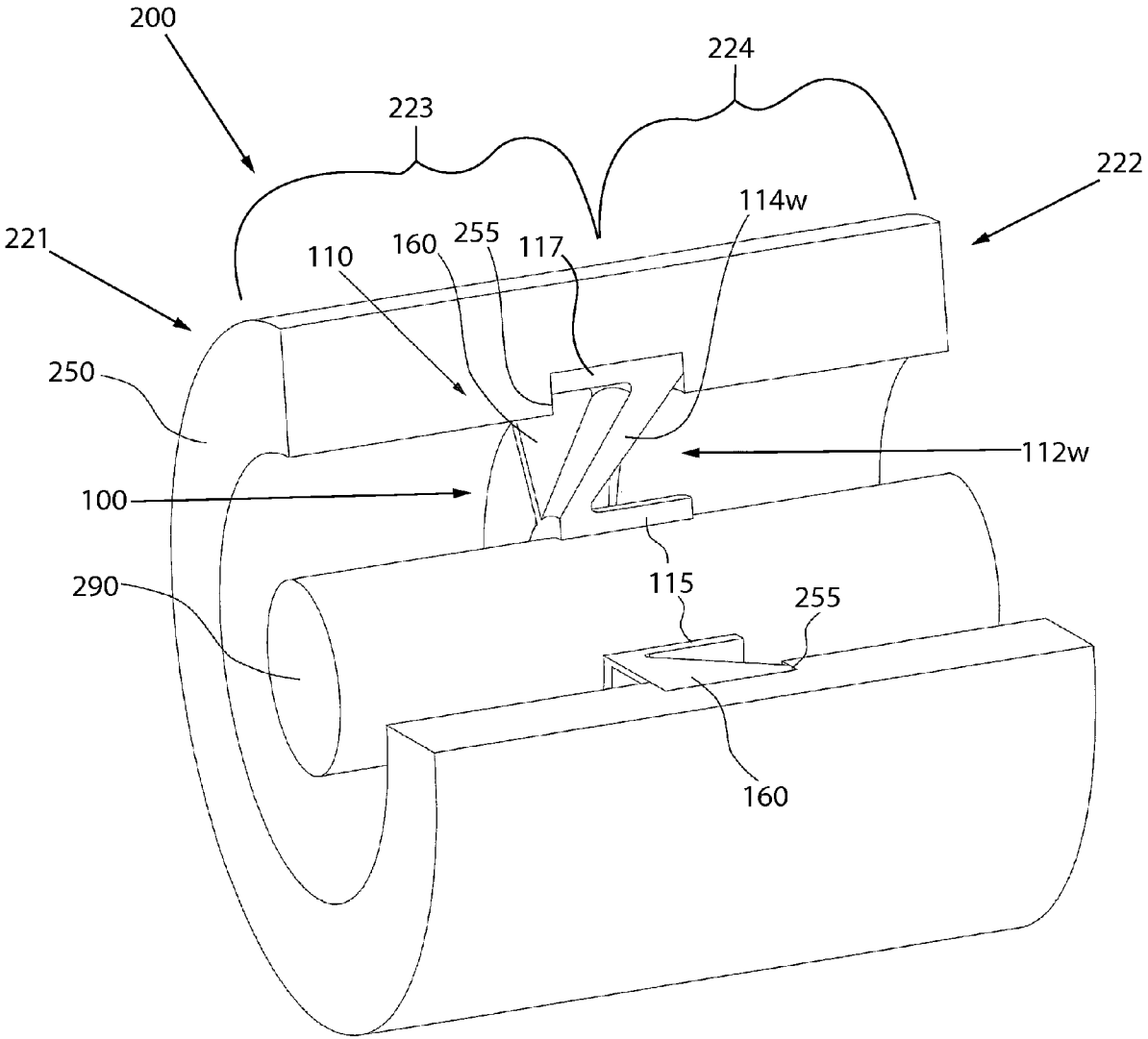
FIG. 8 depicts a partial cut-away perspective view of an embodiment of a coaxial cable connector having an embodiment of a Z-shaped cross-section insulator with variable oblique wall member thickness, in accordance with the present invention.

It should be appreciated that the oblique members 114 of embodiments of coaxial cable connector insulators 100 may vary in wall thickness. For example, FIG. 8 depicts a partial cut-away perspective view of an embodiment of a coaxial cable connector 200 having an embodiment of a Z-shaped cross-section 112W insulator 100 with variable oblique wall member 114W thickness. The overall configuration of the connector 200 and the included insulator 100 may be similar to that shown in FIG. 7. However, as depicted, structural differences include the portion of the diagonal wall member 114W connecting to and extending from the outer ring member 117 being thicker than the portion of the diagonal wall member 114W connecting to and extending from the inner ring member 115. The conical connecting member comprising the wall member 114W of the body 110 of the insulator 100 therefore has a thicker outer portion and a thinner inner portion. Varying the thickness of the diagonal wall member 114 may increase the ability for the insulator 100 to provide radial support and strength to the connector 200 and further help to maintain secure positioning of the outer conductor 250 with respect to the center conductor 290, thereby further supporting compression forces applied to the connector 200.

Figure 9:
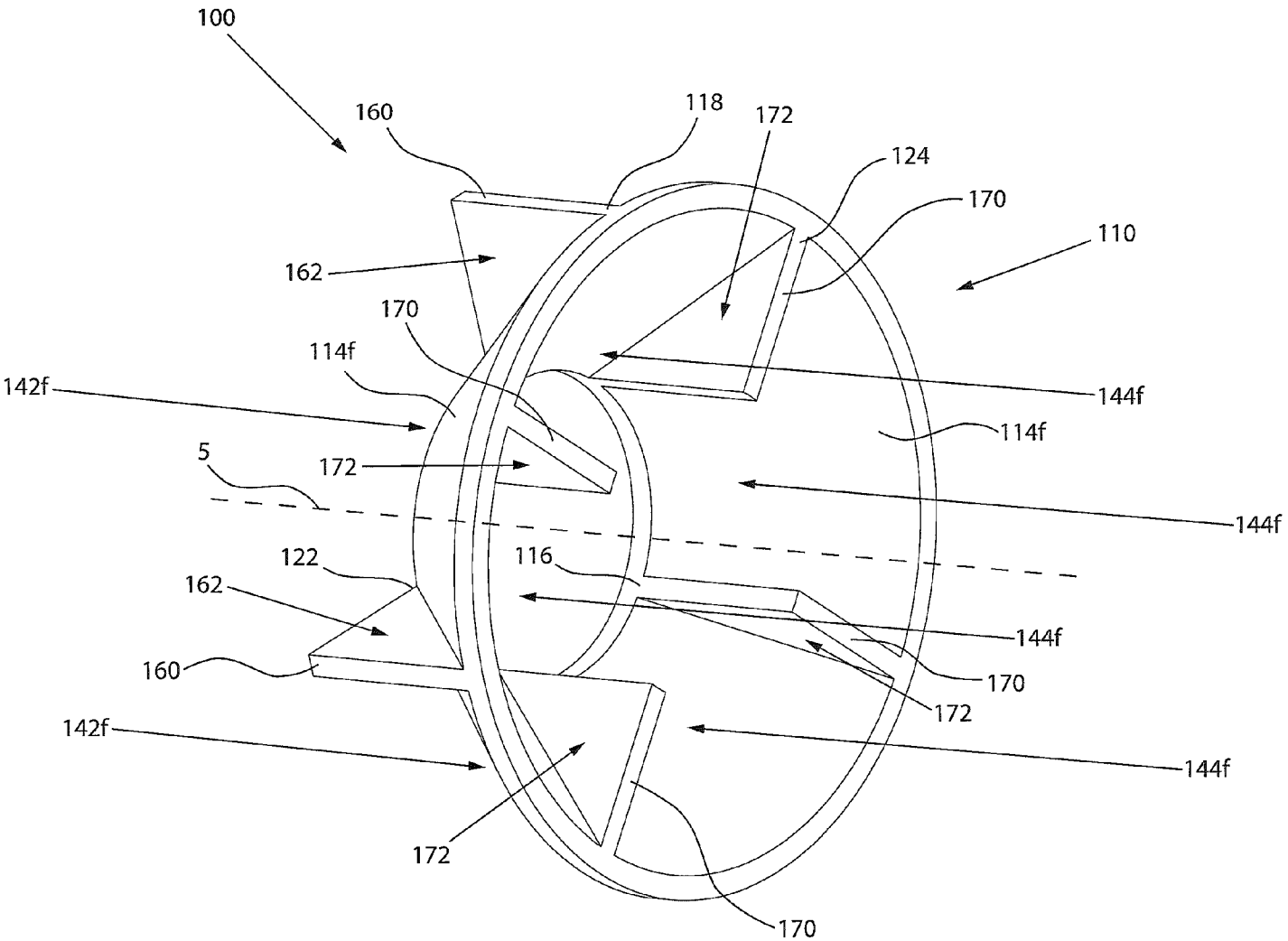
FIG. 9 depicts a perspective view of another embodiment of a coaxial cable insulator having a body that is generally frusto-conical, in accordance with the present invention.

Referring still further to the drawings, FIG. 9 depicts a perspective view of another embodiment of a coaxial cable insulator 100 having a body 110 that is frusto-conical having a circumferential surface, such as outermost radially external surface 118, and extending around a central longitudinal axis 5. In cross-section, a wall member 114*f* extends diagonally between an inner surface 116 to the outermost surface 118 of the body 110. The connector insulator 100 may include a plurality of first reentrant cavities 142*f*. A first reentrant cavity 142*f* ranges between at least two supportive web members 160 and extends from the first axial end 122 of the body 110 to the diagonal wall member 114*f* and comprises a complete void of insulating material between the two associated supportive web members 160, which serve to partially bound the cavity 142*f*. A cavity 142*f* hollows the insulating material between the supportive web members 160 including some portions of insulating material at the outermost radially external surface 118 of the body 110. Hence embodiments of a connector insulator 100 including first reentrant cavities 142*f* have no outer ring members 117, like those found in other insulator embodiments 100, but have a minimized circumferential surface, such as outermost radially external surface 118. As such, the positioning of multiple first reentrant cavities 142*f* between supportive web members 160 forms a generally frusto-conical shape with the supportive web members 160 filling out small segments of the body 110 of the connector insulator 100. The supportive web members 160 may have a generally triangular shape 162 when viewed in cross-section. The connector insulator 100 may also include a plurality of second reentrant cavities 144*f* extending from the second end 124 of the body 110 to the diagonal wall member 114*f*. A second reentrant cavity 144*f* ranges between at least two supportive web members 170 and comprises a void of insulating material between the two associated supportive web members 170, which serve to partially bound the cavity 144*f*. A second cavity 144*f* hollows insulating material between the supportive web members 170 including some portions of the insulating material at the innermost radially internal surface 116 of the body 110. Hence embodiments of a connector insulator 100 including second reentrant cavities 144*f* have no inner ring members 115, like those found in other insulator embodiments 100. As such, the positioning of multiple second reentrant cavities 144*f* between supportive web members 170 forms a generally hollowed frusto-conical shape with the supportive web members 170 filling out small segments of the body 110 of the connector insulator 100. The supportive web members 170 may have a generally triangular shape 172 when viewed in cross-section.

Figure 2:
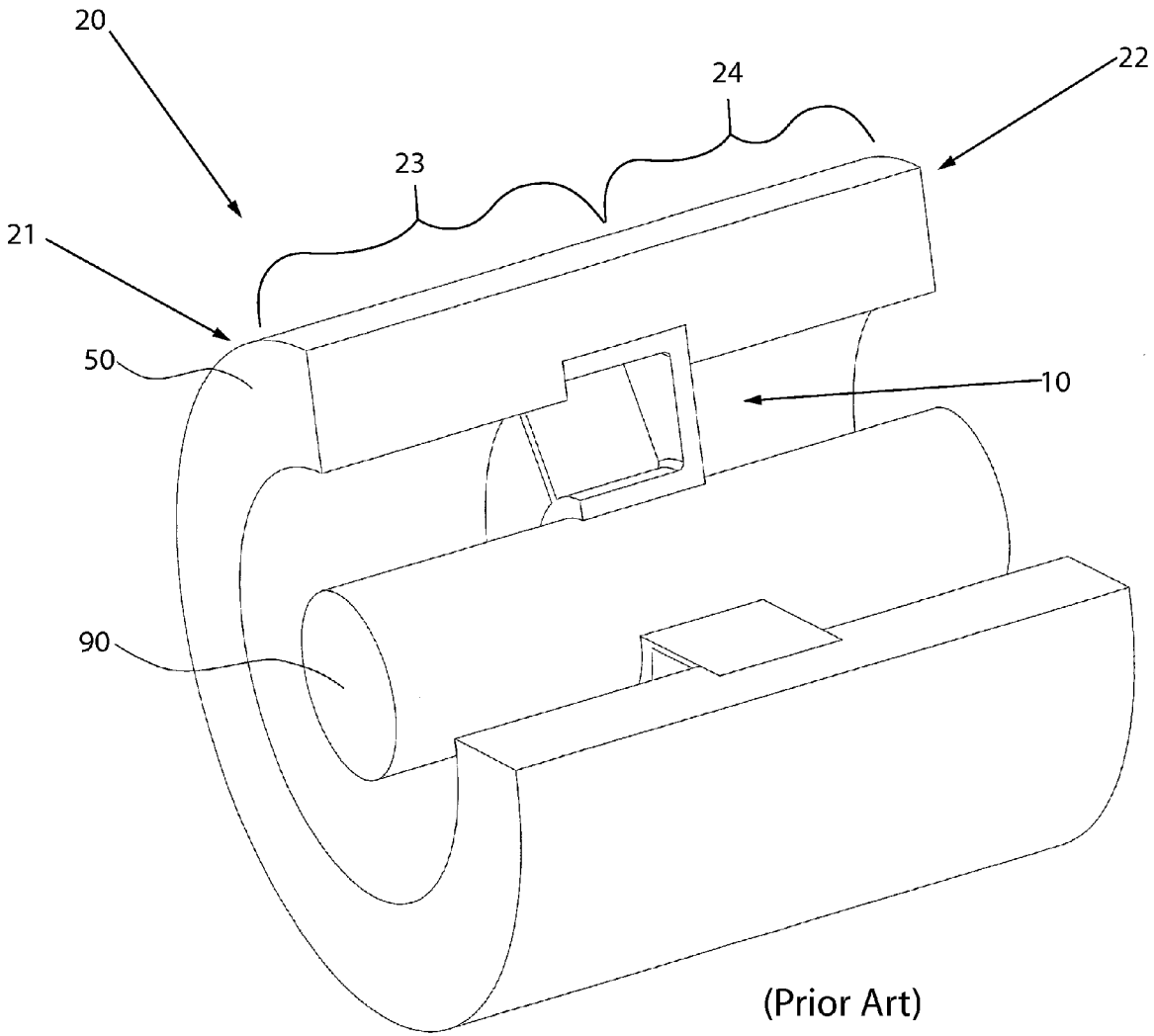
(Prior Art) FIG. 2
FIG. 2 depicts a partial cut-away perspective view of an embodiment of a typical coaxial cable connector having a prior art C-shaped cross-section insulator.
Figure 10:
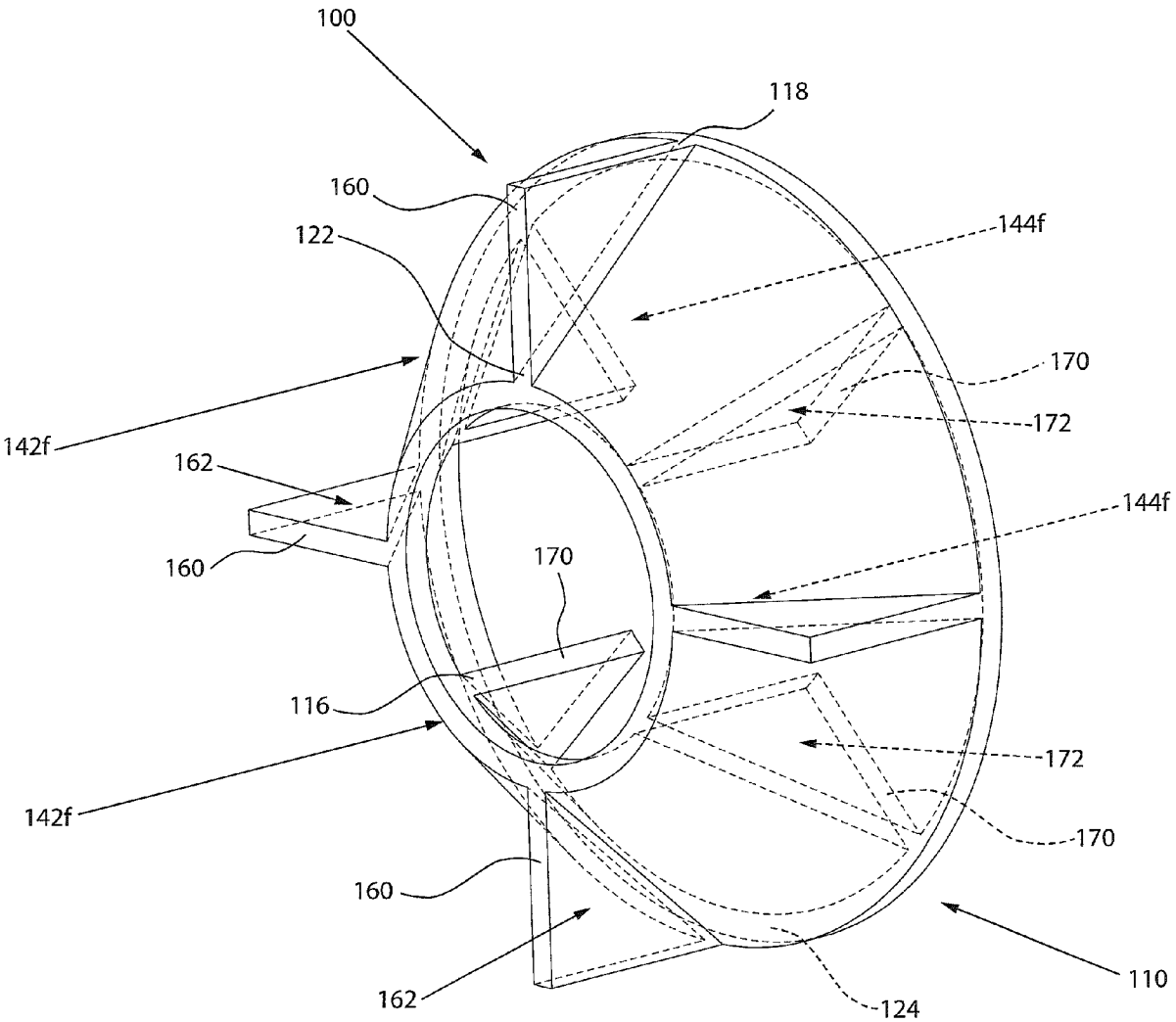
FIG. 10 depicts a perspective view of the embodiment of the coaxial cable connector insulator of FIG. 9 with hidden features depicted by dashed lines, in accordance with the present invention.

Along with the diagonal wall member 114*f*, the supportive web members 160 and 170 of the connector insulator 100 may be fashioned to help support compression forces applied to a coaxial cable connector 200 (see FIGS. 2 and 7-8). FIG. 10 depicts a perspective view of the embodiment of the coaxial cable connector insulator 100 of FIG. 9 with several hidden or non-viewable features, such as inwardly extending supportive web members 170, being depicted by dashed lines. The dashed-line hidden features are provided in FIG. 10, among other things, to reveal that embodiments of a coaxial cable connector insulator 100 may include a plurality of spaced apart supportive web members, wherein the supportive web members alternate spacing between outwardly extending web members 160 and inwardly extending web members 170.

Figure 11A:
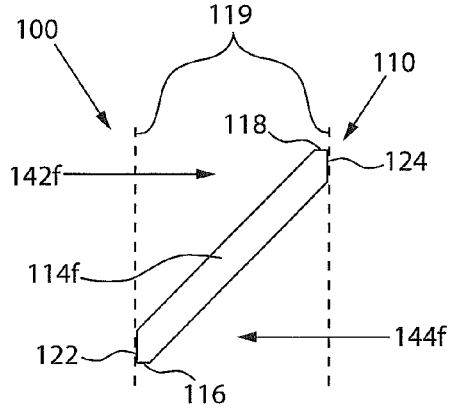
FIG. 11A depicts a cross-section view a portion of the generally frusto-conical insulator embodiment of FIG. 9, in accordance with the present invention.
Figure 11D:
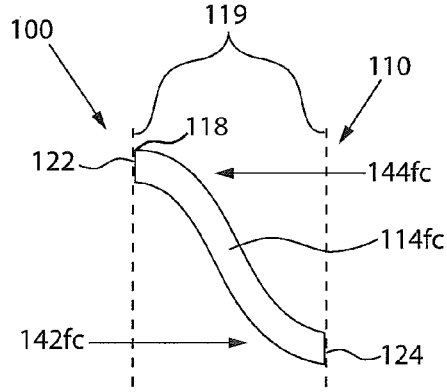
FIG. 11D depicts a cross-section view a portion of a curvy frusto-cuspoidal insulator embodiment, in accordance with the present invention.
Figure 11B:
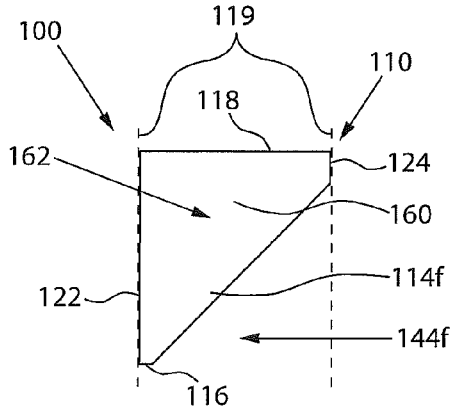
FIG. 11B depicts a cross-section view of another portion of the embodiment of the generally frusto-conical connector insulator of FIG. 9 having an outwardly extending web member, in accordance with the present invention.
Figure 11E:
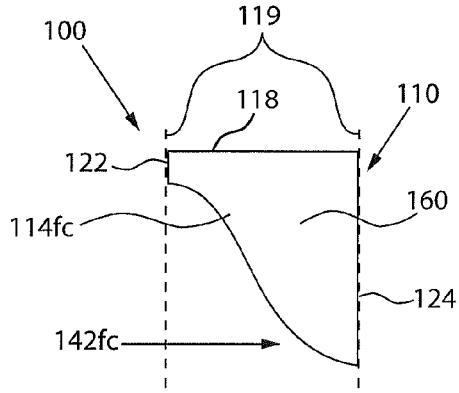
FIG. 11E depicts a cross-section view of another portion of the embodiment of the curvy frusto-cuspoidal connector insulator of FIG. 11D having an outwardly extending web member, in accordance with the present invention.
Figure 11C:
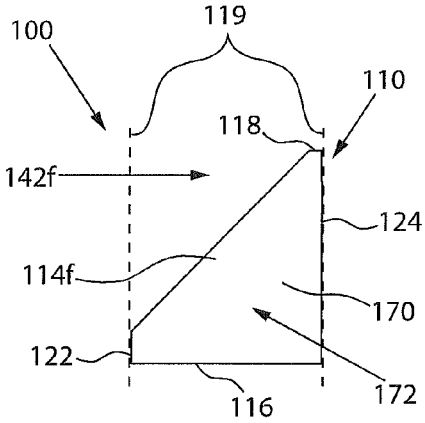
FIG. 11C depicts a cross-section view of still another portion of the embodiment of the generally frusto-conical connector insulator of FIG. 9 having an inwardly extending web member, in accordance with the present invention.

In further reference to the drawings, FIGS. 11A-11C depict cross-section views of various portions of the ring-like generally frusto-conical insulator embodiment 100 of FIG. 9. In the cross-section view of FIG. 11A, the body 110 appears in form as a singular wall member 114*f*. The cross-section of wall member 114*f* extends diagonally between the first axial end 122 and the second axial end 124 of the body 110 so that the body 110 fits within orthogonal boundaries 119 indicated by dashed lines. A first reentrant cavity 142*f* extends from the first axial end 122 toward the second axial end 124 and is bounded by the wall member 114*f*. In areas of the body 110 other than those having upwardly extending supportive wall members 160 (see FIG. 11B), the first reentrant cavity 142*f* comprises a void of all structural insulating material (including material forming an outer ring member 117, see for example FIG. 6A), thereby contributing to the generally frusto-conical shape of the ring-like body 110 of the embodiment of the connector insulator 100. A portion of the wall member 114*f*, in the particular cross-section view of FIG. 11A, serves as a circumferential surface, such as the external surface 118 of the body 110. Those in the art should appreciate that the circumferential surface may be the outermost edge of the body 110 and may look like a point or tip in cross-section view. A second reentrant cavity 144*f* extends from the second axial end 124 toward the first axial end 122 and is bounded by the wall member 114*f*. In areas of the body 110 other than those having inwardly extending supportive wall members 170 (see FIG. 11C), the second reentrant cavity 144*f* comprises a void of all structural insulating material (including material forming an inner ring member 115, see for example FIG. 6A), thereby contributing to the generally frusto-conical shape of the body 110 of the embodiment of the connector insulator 100. A portion of the wall member 114*f*, in the particular cross-section view of FIG. 11A, serves as the internal surface 116 of the body 110.

A frusto-conical body 110 of an embodiment of a connector insulator 100 may include a supportive web member 160 or 170 to help strengthen the insulator's 100 resistance to radial compression forces. For instance, FIG. 11B depicts a cross-section view of a portion of the embodiment of the ring-like generally frusto-conical connector insulator 100 of FIG. 9 having an outwardly extending supportive web member 160. The outwardly extending supportive web member 160 may be integral with the diagonal wall member 114*f*. Axially opposite the outwardly extending supportive web member 160 may be a second reentrant cavity 144*f* extending from the second axial end 124 of the body 110 and bounded by the diagonal wall member 114*f*. The radially external surface 118 of the body 110, as depicted in the particular cross-section view of FIG. 11B, may comprise the radially outermost part of the supportive web member 160 and integral wall member 114*f*. The outwardly extending supportive web member 160 may have a generally triangular shape 162 when viewed in cross-section. Moreover, in the depiction of FIG. 11B, the radially internal surface 116 of the body 110 is a portion of the wall member 114*f*. FIG. 11C depicts a cross-section view of another portion of the embodiment of the generally frusto-conical connector insulator 100 of FIG. 9 having an inwardly extending supportive web member 170. The inwardly extending supportive web member 170 may be integral with the diagonal wall member 114*f*. Axially opposite the inwardly extending supportive web member 170 may be a first reentrant cavity 142*f* extending from the first axial end 122 of the body 110 and bounded by the diagonal wall member 114*f*. The radially internal surface 116 of the body 110, as depicted in the particular cross-section view of FIG. 11C, may comprise the radially innermost part of the supportive web member 170 and integral wall member 114*f*. The inwardly extending supportive web member 160 may have a generally triangular shape 172 when viewed in cross-section. Moreover, in the depiction of FIG. 11C, the radially external surface 118 of the body 110 is a portion of the wall member 114*f*. However, those in the art should recognize that the circumferential surface 118 may be a sharp outermost edge of the body 110.

Figure 11F:
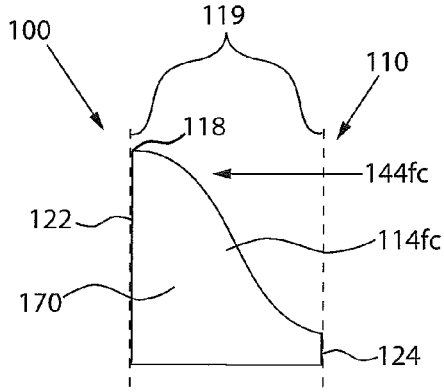
FIG. 11F depicts a cross-section view of still another portion of the embodiment of the curvy frusto-cuspoidal connector insulator of FIG. 11D having an inwardly extending web member, in accordance with the present invention.

Additionally, those in the art should appreciate that body 110 embodiments of a coaxial connector insulator 100 may comprise curved as well as straight shapes. For example, FIGS. 11D-11F depict cross-section views of various portions of a ring-like curvy generally frusto-cuspoidal insulator embodiment 100. In essence, the insulator 100 is shaped similar to a common cusp being rotated around a central longitudinal axis (such as longitudinal axis 5, see FIGS. 1 and 9), wherein the cusp is frustrated having the tip removed, so that the tip does not come to a cusped point. Hence, the ring-like body 110 of such an embodiment of an insulator 100 may be referred to as frusto-cuspoidal. Nomenclature aside, those in the art should note that any such curvy shape of a body 110 having a circumferential surface, such as outermost surface 118, may include at least a portion of the curved shape that is oblique to the central longitudinal axis 5 and thus exhibit properties of reduced signal impedance. As depicted in FIG. 11D, first and second reentrant cavities 142*fc* and 144*fc* may reside on opposite sides of a curvy wall member 114*fc* having a portion that is oblique to a central longitudinal axis 5. The curvy wall member 114 may run from a first axial end 122 to a second axial end 124 and may reside with certain orthogonal boundaries 119 being depicted by dashed lines. A frusto-cuspoidal body 110 of an embodiment of a connector insulator 100 may also include supportive web member 160 and 170, such as are depicted respectively in FIGS. 11E and 11F showing cross-sections of different portions of the ring-like frusto-cuspoidal body 110. The circumferential surface 118 may have a portion that is substantially parallel with the central longitudinal axis 5. However the circumferential surface 118 may also comprise an edge of the body 110 located at an outermost position away from the central longitudinal axis 5.

As it is herein disclosed that the removal or reduction of insulating material and also the oblique structuring of remaining insulating material of an insulator body 110 helps to prevent unwanted signal impedance by coaxial cable connector insulators 100, those in the art should recognize that various oblique structural designs may be operably provided, in accordance with aspects of the present invention (see for example the structuring of FIGS. 6A-6F, 11A and 11D). Other insulator 100 embodiments having different shapes would also provide oblique surfaces that help facilitate more effective impedance matching. For example, a connector insulator embodiment 100 may have an "M"-shaped cross-section rotated about a central axis, wherein the "M," being turned on its side kind of like a sigma symbol "Σ," could have two outer ring members (the tall straight lines on the outside of the "M", or the top and bottom lines of the sigma symbol "Σ") and two oblique connecting members (the slanted lines on the inside of the "M", or the slanted lines of the sigma symbol "Σ"). Similarly, a connector insulator could comprise a "V"-shaped cross-section, wherein the "V" is turned on its side kind of like a less-than symbol "<" or a greater-than symbol ">." Still further, insulator 100 embodiments may comprise a "K"-shaped cross-section, wherein the "K" is laying on its back, or a "W"-shaped cross-section, wherein the "W" is turned on a side. Other cross-section shapes may also be used to provide axial-oblique surfaces of a connector insulator 100 embodiment. It should be recognized that with any cross-section shape of any insulator 100 embodiment, the insulator 100 design may incorporate supportive web members (such as web members 160 and 170) that may increase the stiffness and structural support abilities of the insulator 100.

Figure 12:
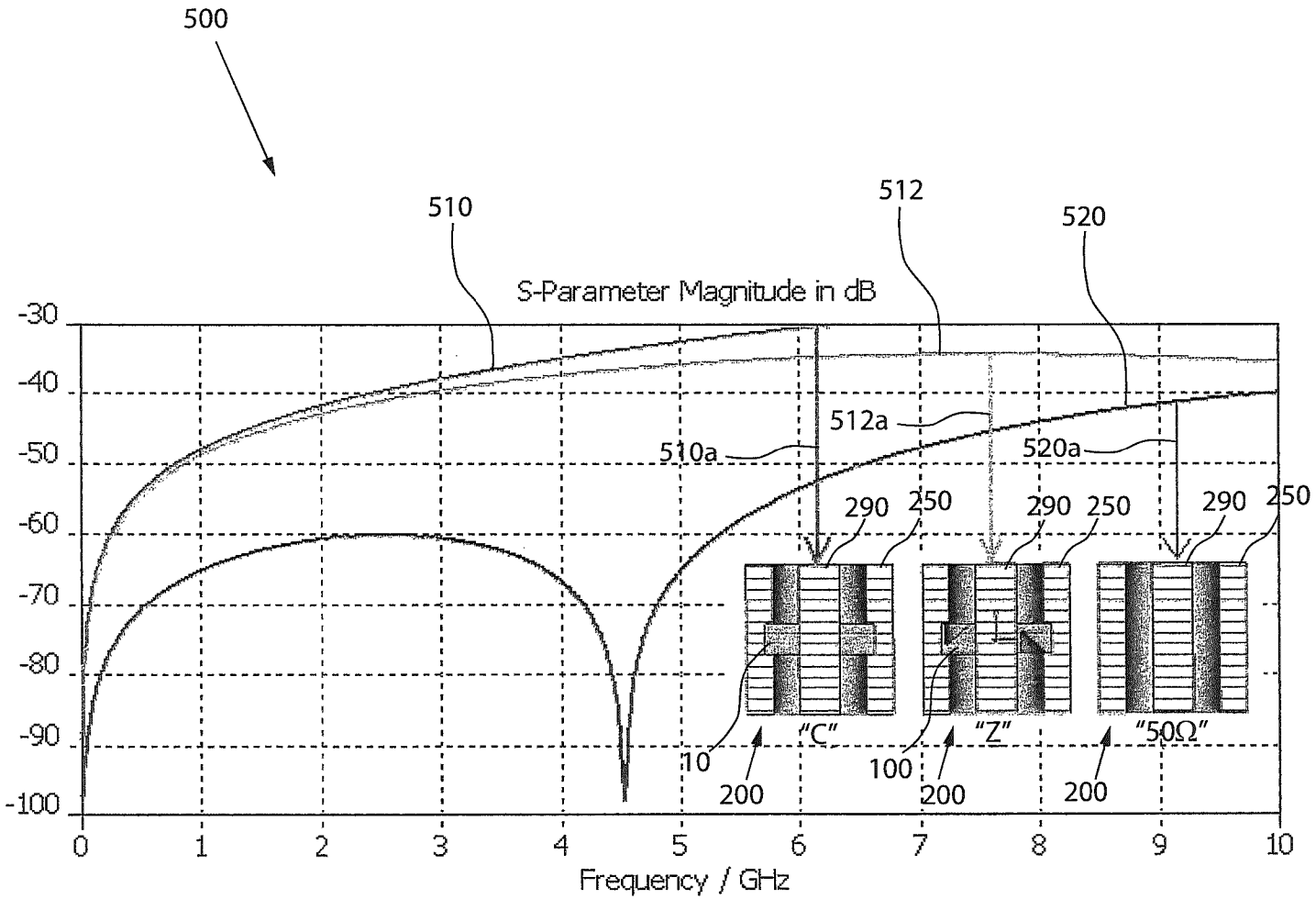
FIG. 12 depicts a comparison plot of return loss for comparative "C-shaped" and "Z-shaped" insulators, and for a standard uniform 50Ω connector model.

A particular insulator embodiment 100 having a Z-shaped cross section 112 of the body 110 (see FIGS. 3, 4, 6A, and 7)

was tested for comparison with a standard C-shaped coaxial cable connector insulator made of injection molded thermoplastic (see connector 10 depicted in FIGS. 1 and 2). Accordingly, FIG. 12 depicts return loss for comparative "C-shaped" 10 and "Z-shaped" 100 insulators, and for a standard uniform 50Ω connector 200 model used for control purposes. The plot 500 reveals that as frequency is increased there is a significant and appreciable difference in the matching of the signal magnitude of connector 200 tested with a C-shaped insulator 10 verses a connector 200 tested with a Z-shaped connector 100 in view of the control model being as model connector 200 having no insulator whatsoever. For example, at 6 GHz the plot-line 510 corresponding to the C-shaped insulator 10, as indicated by associative arrow 510*a*, is 5 dB higher (−30 dB) than the plot-line 512 (−35 dB) corresponding to the model having a Z-shaped insulator 100, as indicated by associative arrow 512*a*. Hence, the model having the Z-shaped insulator 100 was determined to be significantly more matched to the plot-line 520 of the standard 50Ω model, as indicated by associative arrow 520*a*. Thus, a Z-shaped insulator 100 placed in between an outer conductor 250 and a center conductor 290 of coaxial cable connector 200 helps to physically and electrically insulate the connector, provides structural support to the connector 200, and exhibits significantly better matched impedance capability than a common C-shaped insulator 10, as shown in the test data depicted in FIG. 12.

Figure 13:
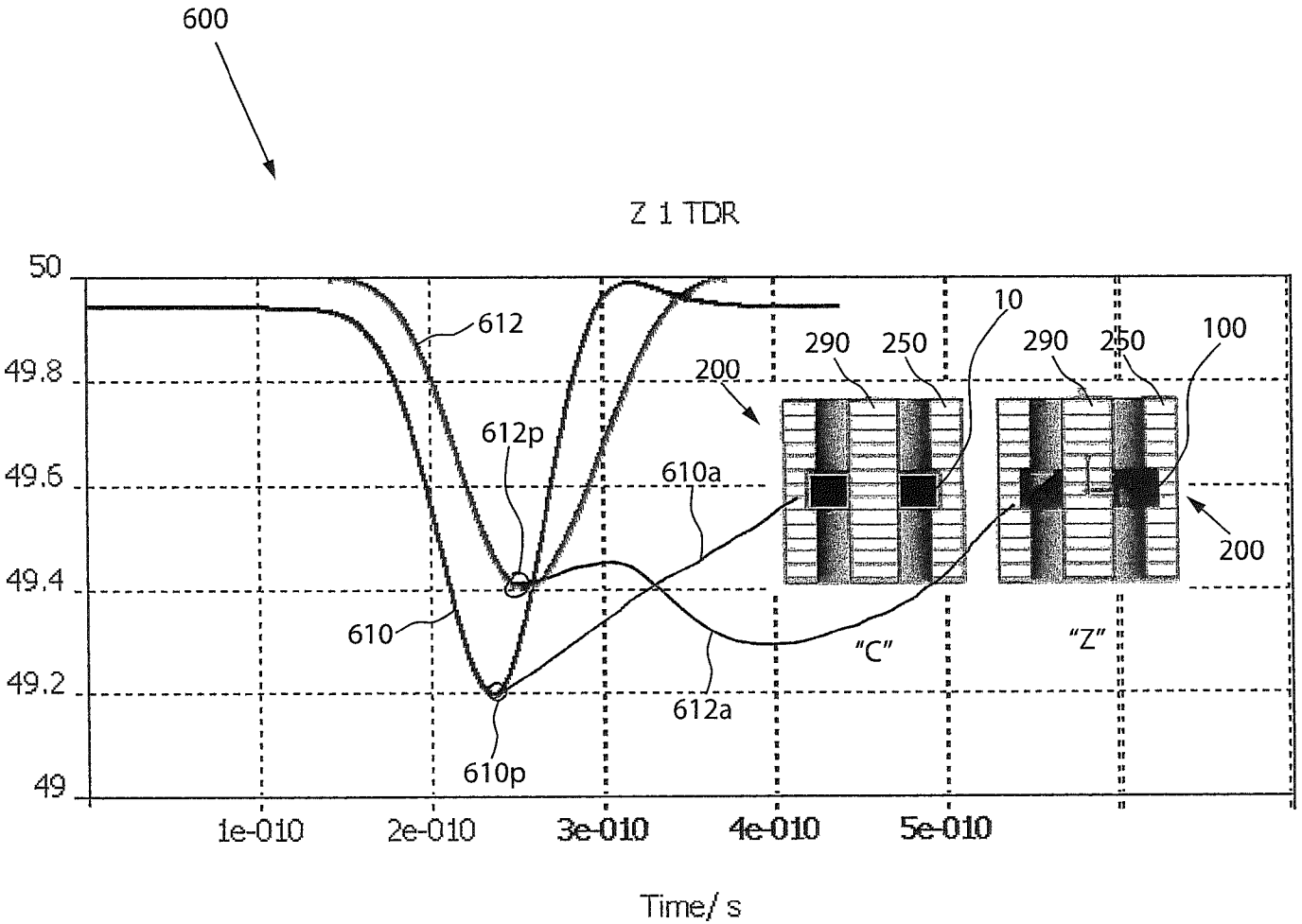
FIG. 13 depicts a comparison plot of time domain impedance of comparable "C-shaped" and "Z-shaped" insulators.

Further testing was conducted using a time domain reflectometer (TDR). A TDR transmits a fast rise time pulse along the conductor. If the conductor is of a uniform impedance and properly terminated, the entire transmitted pulse will be absorbed in the far-end termination and no signal will be reflected back to the TDR. But where impedance discontinuities exist, each discontinuity will create an echo that is reflected back to the reflectometer (hence the name). Increases in the impedance create an echo that reinforces the original pulse while decreases in the impedance create an echo that opposes the original pulse. The resulting reflected pulse that is measured at the output/input to the TDR is displayed or plotted as a function of time and, because the speed of signal propagation is relatively constant for a given transmission medium, can be read as a function of cable length. This is similar in principle to radar. Because of this sensitivity to impedance variations, a TDR may be used to verify cable connector insulator impedance characteristics. FIG. 13 depicts a comparison plot 600 of time domain impedance of a "C-shaped" insulator 10 and a "Z-shaped" insulator 100. As depicted, the connector model 200 having a Z-shaped insulator 100 placed between the center conductor 290 and the outer conductor 250 impeded the test signal shown by plot-line 612 significantly less than the C-shaped insulator 10 impeded the comparable signal shown by plot-line 610. The greatest amount of impedance of the Z-shaped insulator 100 (see associative leader line 612*a*) was measured at around 0.25 nanoseconds at location 612*p* on the plot corresponding to 49.4 ohms, while the greatest amount of impedance of the C-shaped insulator 10 (see associative leader line 610*a*) was measured at around 0.24 nanoseconds at location 610*p* on the plot corresponding to 49.2 ohms. Thus the TDR analysis reveals significant impedance matching properties of the Z-shaped connector 100 having oblique insulating structures over the C-shaped insulator 10 having orthogonal insulating structures. Accordingly, means may be provided for physically stabilizing and electrically insulating the center conductor 290 in relation to the outer conductor 250, wherein the means are located within the connector 200 between a first impedance section 223 of the connector 200 and a second impedance section 224 of the connector 200, wherein the means ensure impedance matching between the first impedance section 223 of the connector 200 and the second impedance section 224 of the connector 200 as measured by time domain reflectometry, wherein the means are comprised of readily injection moldable thermoplastic. The means may include any physical surface of an insulator body 110, wherein the surface has portions that are positioned so as to be oblique to the central longitudinal axis 5.

The means may include embodiments of a connector insulator 100 having minimized insulating material, while including structural members having surfaces which are oblique to the central longitudinal axis, such as axis 5 of the coaxial cable connector, such as connector 200. The oblique structural members may be connecting wall members, such as wall members 114, 114R, 114S, 114W, 114*f*, and 114*fc* shown in FIGS. 3-11. Embodiments of connector insulators 100 having such oblique structural members may be formed of readily injection moldable thermoplastic, the thermoplastic being suitable for physical and electrical insulation.

With further reference to FIGS. 1-13, a coaxial cable connector insulation method is described. One part of the insulation method includes providing a coaxial cable connector 200 including an outer conductor 250 and a center conductor 290 each sharing a central longitudinal axis 5. Another part of the method includes providing an insulator 100, wherein the insulator 100 includes a body 110 having a circumferential surface 118 and a central longitudinal axis. The body 110 also has a first axial end 112 and a second axial end 124, and further includes a first reentrant cavity 142 extending from the first end 122 toward the second end 124, wherein at least a portion of a wall surface 114 of the first reentrant cavity 142 is oblique to the central longitudinal axis 5. The insulator 100 may be formed from injection molded thermoplastic formed. Moreover, the insulator may be formed through a machining process, such as drilling, turning, milling, cutting, grinding, shaving, or otherwise physically removing portions of the insulator material until the desired insulator shape is attained. Still another part of the connector insulation method may include stabilizing the connector 200 by positioning the insulator 100 between the outer conductor 250 and the center conductor 290 to create a sealed physical barrier between the outer conductor 250 and the center conductor 290. While located in such a position, the insulator may also help to support compression forces applied radially and/or axially to the connector to stabilize the concentricity of the inner conductor 290 within the outer conductor 250. Additional connector insulation methodology may include ensuring impedance matching between a first impedance section 223 of the connector 200 and a second impedance section 224 of the connector 200, the first impedance section 223 of the connector 200 extending axially from a first end 221 of the connector to the insulator 100, and the second impedance section 224 of the connector 200 extending axially from a second end 222 of the connector 200 to the insulator 100.

A method of comparatively optimizing impedance characteristics of a coaxial cable connector insulator 100 is discussed with respect to FIGS. 1-13. The method includes a first step A) of providing a first insulator 10. The first insulator 10 may be a common C-shaped insulator made of injection molded thermoplastic. The first insulator 10 may be positioned within a first coaxial cable connector 200 and may be located between an outer conductor 250 of the first connector 200 and an inner conductor 290 of the first connector 200, wherein the first connector 200 has a first end 221 and a second end 222, so that a portion of the first connector 200 extending from the first insulator 10 to the first end 221 of the first connector 200 is a first impedance section 223 of the first connector 200, and so that an opposite portion of the first connector 200 extending from the first insulator 10 to the second end 222 of the first connector 200 is a second impedance section 224 of the first connector 200. An additional method step B) includes providing a second insulator 100. The second insulator 100 should be made of the same material as the first insulator 10, so that the dielectric material properties of the two insulators may be held constant. The second insulator 100 may be positioned within a second coaxial cable connector 200, wherein the second coaxial cable connector 200 is structurally identical to the first coaxial cable connector 200 (hence both the first and second connectors are referenced herein via the same numeral 200), and so that the second insulator 100 is located within the second insulator 200 in a manner that is identical to how the first insulator 10 is located within the first connector 200. Thus the structural relative positioning of the first and second insulators 10 and 100 within the identically structured first and second connectors 200 may be held as a constant.

A further method step C) includes using a time domain reflectometer to transmit a fast rise time pulse axially through the first connector 200 having the first insulator 10, and measuring any resulting reflected pulse at an output/input of the time domain reflectometer. Another similar step D) includes using preferably the same calibrated time domain reflectometer to transmit a fast rise time pulse axially through the second connector 200 having the second insulator 100, and measuring any resulting reflected pulse at an output/input of the time domain reflectometer. A still further method step E) includes plotting any resulting reflected pulse through the first connector 200 having the first insulator 10 and the second connector 200 having the second insulator 100, as a function of time on the same graph, such as the plot 600 depicted in FIG. 13. Yet another method step F) includes evaluating the plot to determine the generalized measure of the ohmic resistance relative to fast rise time pulse transmission through the first connector 200 having the first insulator 10 and the second connector 200 having the second insulator 100 by comparing the quantity of flatness of the plot-lines, such as plot-lines 610 and 612, corresponding to the first connector 200 having the first insulator 10 and the second connector 200 having the second insulator 100. Optimization is facilitated by adjusting the structural design of the second insulator 100 and repeating steps B-F until the difference in plot-line flatness between the plot-line of the first connector 200 having the first insulator 10, such as plot-line 610, and the plot-line of the second connector 200 having the design-adjusted second insulator 100, such as plot-line 612, has been maximized, and so that the plot-line, such as plot-line 612, of the second connector 200 having the second design-adjusted insulator 100 includes the least amount of change in flatness, such as is depicted in plot 600 shown in FIG. 13.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector insulator comprising:

a body having a circumferential surface and a central longitudinal axis, the body having a first axial end and a second axial end, the body including a first reentrant cavity extending from the first end toward the second end, wherein at least a portion of a wall surface of the first reentrant cavity is oblique to the central axis of the body;

wherein the body includes a second reentrant cavity extending from the second end toward the first end, wherein at least a portion of a wall of the second reentrant cavity is oblique to the central axis of the body;

wherein the first cavity and the second cavity share the same wall having an oblique portion, so that the body has a substantially Z-shaped cross-section revolved around the central axis;

wherein an outwardly extending web member runs from the oblique wall of the Z-shaped cross-section to a radially outermost portion of the Z-shaped cross-section to form a generally triangular cross-section shape.

2. The connector insulator of claim 1, further comprising an inwardly extending web member running from the oblique wall of the Z-shaped cross-section to a radially innermost portion of the Z-shaped cross-section to form a generally triangular cross-section shape.

3. The connector insulator of claim 1, wherein the body is generally frusto-conical shaped.

4. The connector insulator of claim 1, wherein the connector insulator is formed of readily injection moldable thermoplastic.

5. A coaxial cable connector insulator comprising:

an inner ring member, having a first axial end and a second axial end;

an outer ring member, being coaxial with the inner ring member and radially surrounding at least a portion of the inner ring member; and a connecting member extending between and integrating the inner ring member and the outer ring member, wherein at least a portion of the connecting member is oblique to the shared axis of the inner and outer ring members;

wherein the connecting member has variable wall thickness.

6. The connector insulator of claim 5, wherein the connecting member extends diagonally between the inner ring member and the outer ring member.

7. The connector insulator of claim 5, wherein the connecting member is curved so that the connecting member has a substantially S-shaped cross section.

8. The connector insulator of claim 5, further comprising an outwardly extending supportive web member running from the connecting member to the outer ring member to form a generally triangular cross-section shape.

9. The connector insulator of claim 8, further comprising an inwardly extending web member running from the conical member to the inner ring member to form a generally triangular cross-section shape.

10. The connector insulator of claim 9, further comprising a plurality of spaced apart web members, wherein the web members include outwardly extending web members and inwardly extending web members, the web members being alternatively located in various structural patterns.

11. A coaxial cable connector comprising:

an outer conductor;

a center conductor, positioned coaxially within the outer conductor; and an insulator, positioned between the outer conductor and the center conductor, wherein the insulator includes a body having a substantially Z-shaped cross-section revolved around the shared axis of the outer conductor and the center conductor;

wherein insulator further includes an outwardly extending web member running from a diagonal portion of the Z-shaped cross-section to a radially outermost portion of the Z-shaped cross-section to form a generally triangular cross-section shape that supports compression forces applied to the connector.

12. The connector of claim 11, wherein insulator further includes an inwardly extending web member running from a diagonal portion of the Z-shaped cross-section to a radially innermost portion of the Z-shaped cross-section to form a generally triangular cross-section shape that supports compression forces applied to the connector.

13. The connector of claim 12, wherein the insulator further includes a plurality of spaced apart web members, wherein the web members include outwardly extending web members and inwardly extending web members, the web members being alternatively located in various structural patterns.

* * * * *